US010807212B2

(12) United States Patent
Xue et al.

(10) Patent No.: US 10,807,212 B2
(45) Date of Patent: Oct. 20, 2020

(54) WHEEL BURR REMOVING DEVICE

(71) Applicant: CITIC Dicastal CO.,LTD, Qinhuangdao (CN)

(72) Inventors: Bowen Xue, Qinhuangdao (CN); Weizhi Zhang, Qinhuangdao (CN); Jiandong Guo, Qinhuangdao (CN)

(73) Assignee: CITIC DICASTAL CO., LTD, Qinhuangdao, Hebei (CN)

( * ) Notice: Subject to any disclaimer, the term of this patent is extended or adjusted under 35 U.S.C. 154(b) by 344 days.

(21) Appl. No.: 15/940,125

(22) Filed: Mar. 29, 2018

(65) Prior Publication Data

US 2019/0193236 A1 Jun. 27, 2019

(30) Foreign Application Priority Data

Dec. 21, 2017 (CN) ..... 2017 1 13943498

(51) Int. Cl.

| | |
|---|---|
| ***B24B 27/04*** | (2006.01) |
| ***B24B 55/06*** | (2006.01) |
| ***B24B 27/00*** | (2006.01) |
| ***B24B 29/00*** | (2006.01) |

(52) U.S. Cl.

CPC ..... *B24B 27/04* (2013.01); *B24B 27/0084* (2013.01); *B24B 29/005* (2013.01); *B24B 55/06* (2013.01)

(58) Field of Classification Search

CPC ... B24B 27/04; B24B 27/0084; B24B 29/005; B24B 55/06; B24B 9/04; B24B 19/28; B24B 5/44; B24B 41/02; B24B 29/00; B24B 5/46; B24B 5/40; B24B 29/04

See application file for complete search history.

(56) References Cited

U.S. PATENT DOCUMENTS

| | | | | |
|---|---|---|---|---|
| 9,782,866 | B1 * | 10/2017 | Xue | B24B 9/04 |
| 10,022,834 | B2 * | 7/2018 | Xue | B24B 29/005 |
| 10,232,485 | B2 * | 3/2019 | Xue | B24B 5/44 |
| 10,239,181 | B2 * | 3/2019 | Xue | B24B 27/0023 |
| 10,279,449 | B2 * | 5/2019 | Xue | B24B 9/04 |
| 10,486,282 | B2 * | 11/2019 | Liu | B24B 29/005 |

FOREIGN PATENT DOCUMENTS

| | | |
|---|---|---|
| CN | 105598776 A | 5/2016 |
| CN | 106312733 A | 1/2017 |
| CN | 107030561 A | 8/2017 |

* cited by examiner

*Primary Examiner* — Dung Van Nguyen
(74) *Attorney, Agent, or Firm* — Calfee, Halter & Griswold LLP

(57) ABSTRACT

The application discloses a wheel burr removing device, which includes a lower brush system, a synchronous clamping and rotating system, an upper brush system and the like. The device may be used for removing burrs from a riser, an upper flange, a center hole and a flange plate edge of a wheel, and has the characteristics of high automation degree, advanced process, strong universality and high safety and stability at the same time.

1 Claim, 3 Drawing Sheets

WHEEL BURR REMOVING DEVICE

CROSS-REFERENCE TO RELATED APPLICATIONS

This application claims priority to Chinese Patent Application No. 201711394349.8 filed on Dec. 21, 2017, which is hereby incorporated by reference in its entirety.

TECHNICAL FIELD

The present application relates to a burr removing device, and specifically, to a wheel burr removing device.

BACKGROUND ART

In the machining process of an aluminum alloy wheel, cut edges are often produced at a riser, an upper flange, a center hole and a flange plate edge of the wheel due to the technical restrict, burrs are formed at these parts in the presence of the cut edges, and if the burrs are not removed in time, the subsequent coating effect will be seriously affected.

SUMMARY OF THE INVENTION

The aim of the present application is to provide a wheel burr removing device, which may be used for removing burrs from a riser, an upper flange, a center hole and a flange plate edge of a wheel.

In order to fulfill the above aim, the technical solution of the present application is: a wheel burr removing device, includes a frame, guide posts I, guide sleeves I, a cylinder I, a lower fixed plate, a rotary joint, a spline shaft, a belt pulley I, a synchronous belt I, a belt pulley II, a shaft I, a bearing seat I, a spline sleeve, a bearing seat II, a bearing seat III, a shaft II, a gear ring, a gear I, a brush head, a brush disc, an upper fixed plate, a gear II, racks, guide rails I, a left sliding plate, left shafts, left bearing seats, V-shaped rollers, a belt pulley III, a swing arm, a brush belt, a fixed support, a belt pulley IV, a shaft III, a bearing seat IV, a sliding support, a servo motor I, a guide rail II, an upper lifting plate, guide posts II, guide sleeves II, cylinders II, a cylinder II, a belt pulley V, right shafts, right bearing seats, a right sliding plate, a servo motor II, a cylinder IV, a lower lifting plate, a belt pulley VI, a synchronous belt II, a belt pulley VII, a servo motor III, cylinders V, a turnover shaft, a servo motor IV, a servo motor V and the like.

A lower brush system includes: the four guide sleeves I are fixed on the lower fixed plate, and the guide posts I matched with the guide sleeves I are fixed below the lower lifting plate; the two cylinders V are also fixed below the lower fixed plate, and the output ends of the two cylinders V are articulated with the lower part of the lower lifting plate; the bearing seat II is fixed above the lower lifting plate and arranged in the middle; the spline sleeve is mounted inside the bearing seat II via a bearing; the spline shaft is matched with the inner wall of the spline sleeve; the brush head is fixed at the upper end of the spline shaft, and the lower end of the spline shaft is connected with the upper end of the rotary joint; the cylinder I is fixed below the lower lifting plate via a transition flange, and the output end of the cylinder I is connected with the lower part of the rotary joint; both the belt pulley I and the belt pulley VI are fixed below the spline sleeve, and the belt pulley I is arranged below the belt pulley VI; the bearing seat I is fixed above the lower lifting plate, and is concentric with the bearing seat II; the shaft II is mounted outside the bearing seat III via bearings; the gear ring is fixed outside the shaft II; the brush disc is fixed at the top of the shaft II; the bearing seat I is fixed on the lower lifting plate, and arranged on the left side of the shaft II; the shaft I is mounted inside the bearing seat I via bearings; the gear I is fixed at the top of the shaft I, and engaged with the gear ring; the belt pulley II is fixed below the shaft I; the belt pulley I is connected with the belt pulley II via the synchronous belt I; the servo motor II is fixed on the right side of the lower part of the lower lifting plate via a transition flange, and the belt pulley VII is fixed at the output end of the servo motor III; and the belt pulley VI is connected with the belt pulley VII via the synchronous belt II.

A synchronous clamping and rotating system includes: the gear II is fixed above the upper fixed plate; the left sliding plate is mounted above the upper fixed plate via a guide rail I; the two left bearing seats are fixed above the left sliding plate; the two left shafts are mounted inside the left bearing seats via bearings; two V-shaped rollers are respectively fixed above the two left shafts; the right sliding plate is mounted above the upper fixed plate via a guide rail I; the two right bearing seats are fixed above the right sliding plate; the two right shafts are mounted inside the right bearing seats via bearings; two V-shaped rollers are respectively fixed above the two right shafts; racks are respectively fixed below the left sliding plate and the right sliding plate, and simultaneously engaged with the gear II; the servo motor II is fixed below the right sliding plate, and the output end of the servo motor II is connected with one right shaft; the cylinder IV is fixed on the right side of the frame, and the output end of the cylinder IV is connected with the right sliding plate.

An upper brush system includes: the belt pulley IV and the belt pulley V are mounted above the fixed support via pin rolls; the upper part of the swing arm is mounted on the fixed support via the turnover shaft; the servo motor IV is fixed on the lateral surface of the fixed support, and the output end of the servo motor IV is connected with one side of the turnover shaft; the belt pulley III is mounted below the swing arm; the servo motor V is fixed on the lateral surface of the fixed support, and the output end of the servo motor V is connected with the belt pulley V; the belt pulley IV, the belt pulley V and the belt pulley III are connected by the brush belt; the bearing seat IV is fixed below a bottom plate of the sliding support; the shaft III is mounted inside the bearing seat IV via bearings, and the fixed support is fixed below the shaft II; the servo motor I is fixed above a bottom plate of the sliding support, and the output end of the servo motor I is connected with the top of the shaft III; the top of the sliding support is mounted below the upper lifting plate via the guide rail II; the cylinder III is fixed on the right side of the lower part of the upper lifting plate, and the output end of the cylinder III is connected with the sliding support; the four guide posts II are fixed above the upper lifting plate, and the four guide sleeves II matched with the guide posts II are fixed at the top of the frame; the two cylinders II are also fixed at the top of the frame, and the output ends of the two cylinders II are articulated with the upper part of the upper lifting plate.

In the working process, the cylinder IV drives the four V-shaped rollers via the gear I, the racks and the guide rails I to synchronously clamp a wheel, and the servo motor II drives the wheel via the right shafts to rotate; the cylinder I drives the belt pulley III via the guide rail II to be located above a riser of the wheel, and the servo motor V drives the brush belt to rotate; meanwhile, the servo motor I drives the brush belt via the shaft III to rotate circumferentially; the cylinders II drive the belt pulley I via the guide posts II to descend, and when the belt pulley III contacts the riser of the wheel, burrs thereon may be removed; the angles of the swing arm and the belt pulley III are adjusted via the servo motor IV, and burrs may be removed from an upper flange; the servo motor III drives the spline shaft, the spline sleeve and the belt pulley I via the synchronous belt II to rotate so as to drive the brush head to rotate, and ascending and descending of the brush head may be realized via the cylinder I; the gear I may be driven by the synchronous belt I and the belt pulley II to rotate, and is engaged with the gear ring to drive the shaft II and the brush disc to rotate; the lifting motion of the brush disc may be realized by means of the cylinders V via the guide posts I, and when the brush disc contacts the edge of a flange plate of the wheel, burrs thereon may be removed.

The present application may be used for removing burrs from a riser, an upper flange, a center hole and a flange plate edge of a wheel, and has the characteristics of high automation degree, advanced process, strong universality and high safety and stability at the same time.

Figure 1:
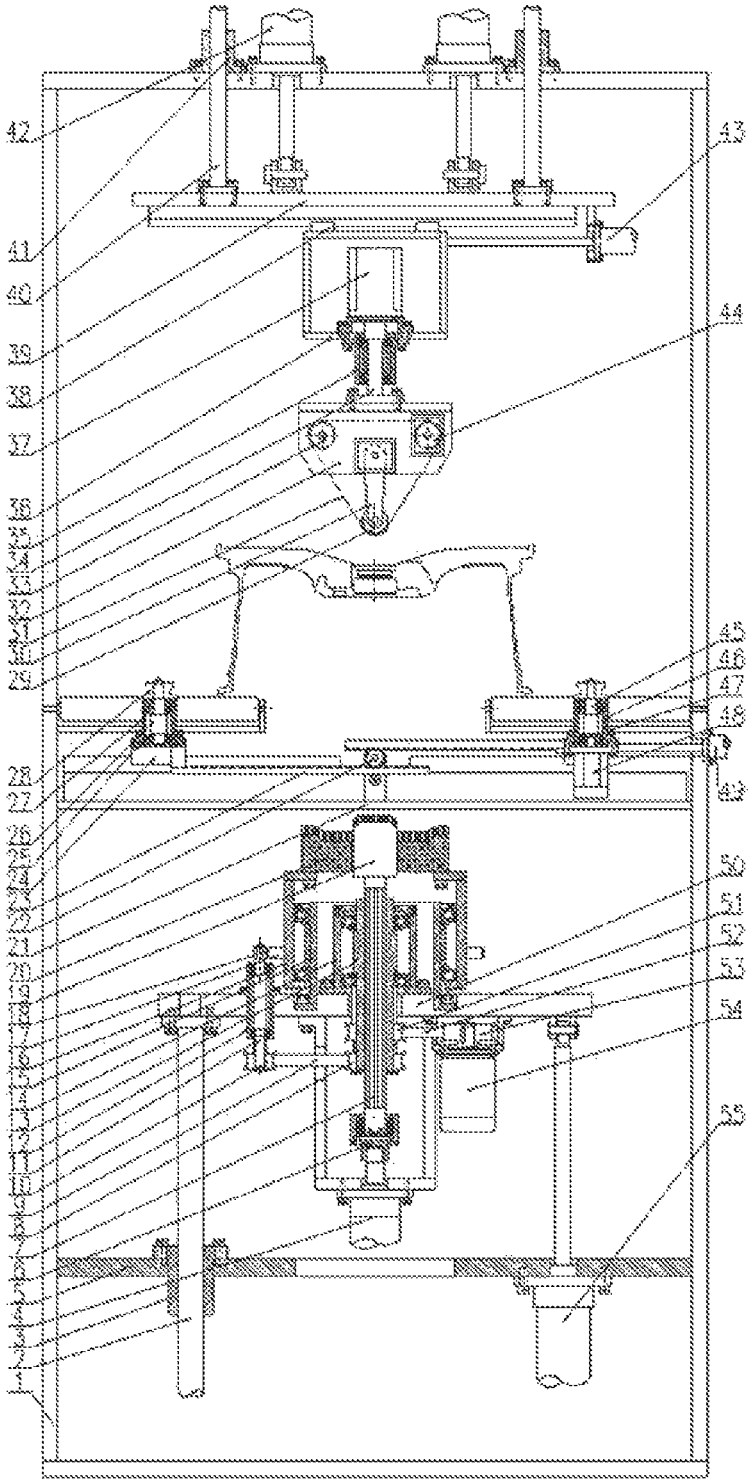
FIG. 1 is a front view of a wheel burr removing device of the present application.
Figure 2:
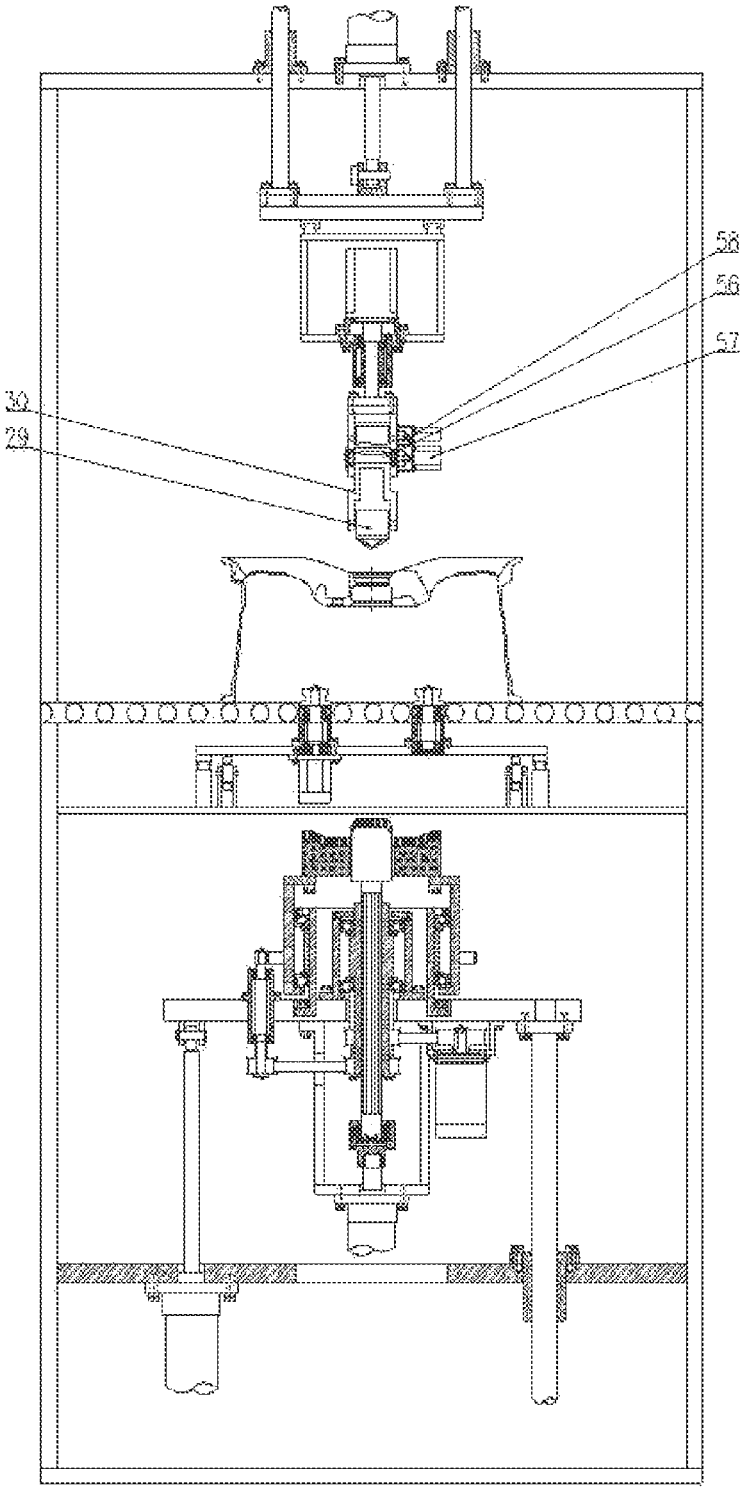
FIG. 2 is a left view of the wheel burr removing device of the present application.
Figure 3:
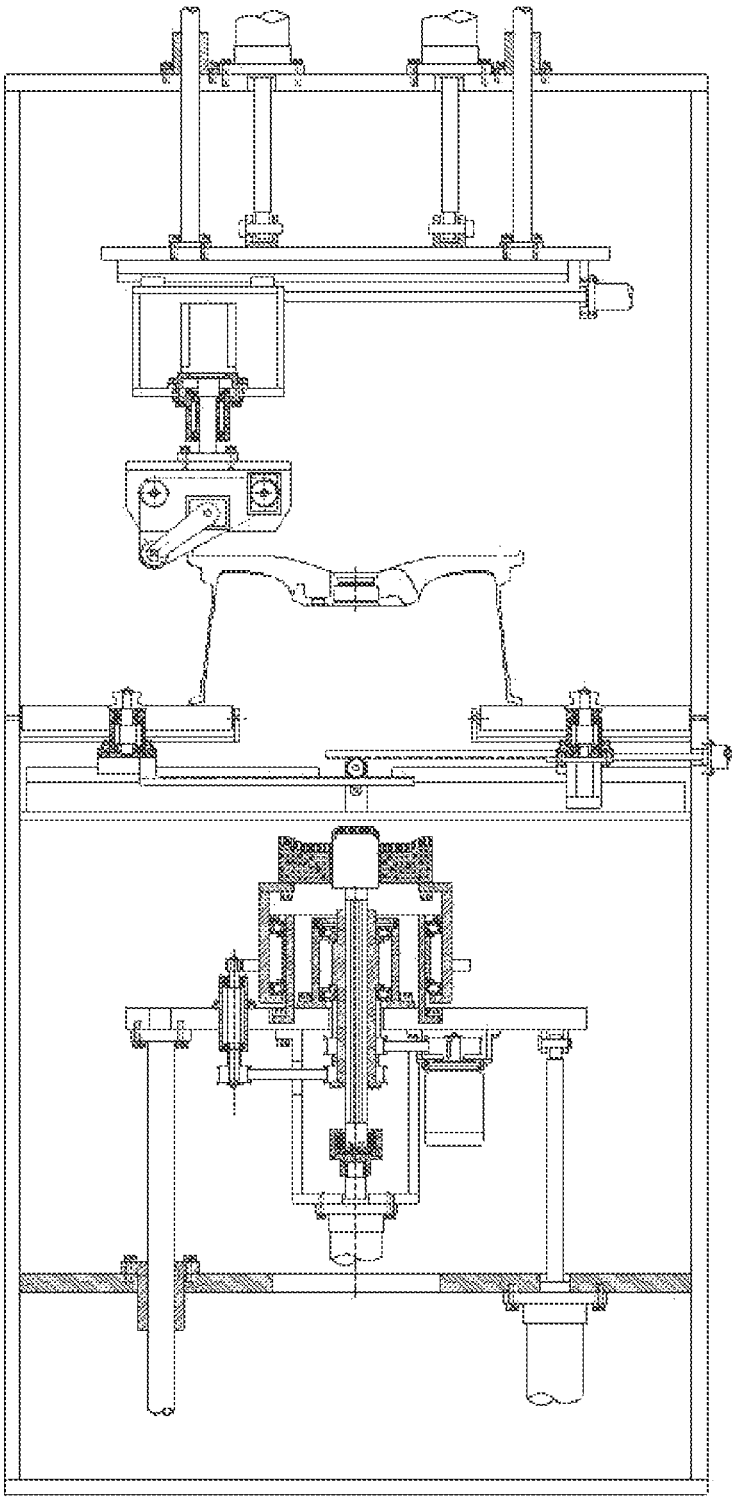
FIG. 3 is a front view when the wheel burr removing device of the present application removes burrs from an upper flange.

In which, 1—frame, 2—guide post I, 3—guide sleeve I, 4—cylinder I, 5—lower fixed plate, 6—rotary joint, 7—spline shaft, 8—belt pulley I, 9—synchronous belt I, 10—belt pulley II, 11—shaft I, 12—bearing seat I, 13—spline sleeve, 14—bearing seat II, 15—bearing seat II, 16—shaft II, 17—gear ring, 18—gear I, 19—brush head, 20—brush disc, 21—upper fixed plate, 22—gear II, 23—rack, 24—guide rail I, 25—left sliding plate, 26—left shaft, 27—left bearing seat, 28—V—shaped roller, 29—belt pulley III, 30—swing arm, 31—brush belt, 32—fixed support, 33—belt pulley IV, 34—shaft III, 35—bearing seat IV, 36—sliding support, 37—servo motor I, 38—guide rail II, 39—upper lifting plate, 40—guide post II, 41—guide sleeve II, 42—cylinder II, 43—cylinder III, 44—belt pulley V, 45—right shaft, 46—right bearing seat, 47—right sliding plate, 48—servo motor II, 49—cylinder IV, 50—lower lifting plate, 51—belt pulley VI, 52—synchronous belt II, 53—belt pulley VII, 54—servo motor III, 55—cylinder V, 56—turnover shaft, 57—servo motor IV, 58—servo motor V.

DETAILED DESCRIPTION OF THE INVENTION

Specific details and working conditions of a device provided by the present application will be described below in combination with the accompanying drawings.

The device includes a frame 1, guide posts I 2, guide sleeves I 3, a cylinder I 4, a lower fixed plate 5, a rotary joint 6, a spline shaft 7, a belt pulley I 8, a synchronous belt I 9, a belt pulley II 10, a shaft I 11, a bearing seat I 12, a spline sleeve 13, a bearing seat II 14, a bearing seat III 15, a shaft II 16, a gear ring 17, a gear I 18, a brush head 19, a brush disc 20, an upper fixed plate 21, a gear II 22, racks 23, guide rails I 24, a left sliding plate 25, left shafts 26, left bearing seats 27, V-shaped rollers 28, a belt pulley III 29, a swing arm 30, a brush belt 31, a fixed support 32, a belt pulley IV 33, a shaft III 34, a bearing seat IV 35, a sliding support 36, a servo motor I 37, a guide rail II 38, an upper lifting plate 39, guide posts II 40, guide sleeves II 41, cylinders II 42, a cylinder III 43, a belt pulley V 44, right shafts 45, right bearing seats 46, a right sliding plate 47, a servo motor II 48, a cylinder IV 49, a lower lifting plate 50, a belt pulley VI 51, a synchronous belt II 52, a belt pulley VII 53, a servo motor III 54, cylinders V 55, a turnover shaft 56, a servo motor IV 57, a servo motor V 58 and the like.

A lower brush system includes: the four guide sleeves I 3 are fixed on the lower fixed plate 5, and the guide posts I 2 matched with the guide sleeves I 3 are fixed below the lower lifting plate 50; the two cylinders V 55 are also fixed below the lower fixed plate 5, and the output ends of the two cylinders V 55 are articulated with the lower part of the lower lifting plate 50; the bearing seat II 14 is fixed above the lower lifting plate 50 and arranged in the middle; the spline sleeve 13 is mounted inside the bearing seat II 14 via a bearing; the spline shaft 7 is matched with the inner wall of the spline sleeve 13; the brush head 19 is fixed at the upper end of the spline shaft 7, and the lower end of the spline shaft 7 is connected with the upper end of the rotary joint 6; the cylinder I 4 is fixed below the lower lifting plate 50 via a transition flange, and the output end of the cylinder I 4 is connected with the lower part of the rotary joint 6; both the belt pulley I 8 and the belt pulley VI 51 are fixed below the spline sleeve 13, and the belt pulley I 8 is arranged below the belt pulley VI 51; the bearing seat III 15 is fixed above the lower lifting plate 50, and is concentric with the bearing seat II 14; the shaft II 16 is mounted outside the bearing seat III 15 via bearings; the gear ring 17 is fixed outside the shaft II 16; the brush disc 20 is fixed at the top of the shaft II 16; the bearing seat I 12 is fixed on the lower lifting plate 50, and arranged on the left side of the shaft II 16; the shaft I 11 is mounted inside the bearing seat I 12 via bearings; the gear I 18 is fixed at the top of the shaft I 11, and engaged with the gear ring 17; the belt pulley II 10 is fixed below the shaft I 11; the belt pulley I 8 is connected with the belt pulley II 10 via the synchronous belt I 9; the servo motor III 54 is fixed on the right side of the lower part of the lower lifting plate 50 via a transition flange, and the belt pulley VII 53 is fixed at the output end of the servo motor III 54; and the belt pulley VI 51 is connected with the belt pulley VII 53 via the synchronous belt II 52.

A synchronous clamping and rotating system includes: the gear II 22 is fixed above the upper fixed plate 21; the left sliding plate 25 is mounted above the upper fixed plate 21 via a guide rail I 24; the two left bearing seats 27 are fixed above the left sliding plate 25; the two left shafts 26 are mounted inside the left bearing seats 27 via bearings; two V-shaped rollers 28 are respectively fixed above the two left shafts 26; the right sliding plate 47 is mounted above the upper fixed plate 21 via a guide rail I 24; the two right bearing seats 46 are fixed above the right sliding plate 47; the two right shafts 45 are mounted inside the right bearing seats 46 via bearings; two V-shaped rollers 28 are respectively fixed above the two right shafts 45; racks 23 are respectively fixed below the left sliding plate 25 and the right sliding plate 47, and simultaneously engaged with the gear II 22; the servo motor II 48 is fixed below the right sliding plate 47, and the output end of the servo motor II 48 is connected with one right shaft 45; the cylinder IV 49 is fixed on the right side of the frame 1, and the output end of the cylinder IV 49 is connected with the right sliding plate 47.

An upper brush system includes: the belt pulley IV 33 and the belt pulley V 44 are mounted above the fixed support 32 via pin rolls; the upper part of the swing arm 30 is mounted on the fixed support 32 via the turnover shaft 56; the servo motor IV 57 is fixed on the lateral surface of the fixed support 32, and the output end of the servo motor IV 57 is connected with one side of the turnover shaft 56; the belt pulley III 29 is mounted below the swing arm 30; the servo motor V 58 is fixed on the lateral surface of the fixed support 32, and the output end of the servo motor V 58 is connected with the belt pulley V 44; the belt pulley IV 33, the belt pulley V 44 and the belt pulley III 29 are connected by the brush belt 31; the bearing seat IV 35 is fixed below a bottom plate of the sliding support 36; the shaft III 34 is mounted inside the bearing seat IV 35 via bearings, and the fixed support 32 is fixed below the shaft III 34; the servo motor I 37 is fixed above a bottom plate of the sliding support 36, and the output end of the servo motor I 37 is connected with the top of the shaft III 34; the top of the sliding support 36 is mounted below the upper lifting plate 39 via the guide rail II 38; the cylinder III 43 is fixed on the right side of the lower part of the upper lifting plate 39, and the output end of the cylinder III 43 is connected with the sliding support 36; the four guide posts II 40 are fixed above the upper lifting plate 39, and the four guide sleeves II 41 matched with the guide posts II 40 are fixed at the top of the frame 1; the two cylinders II 42 are also fixed at the top of the frame 1, and the output ends of the two cylinders II 42 are articulated with the upper part of the upper lifting plate 39.

In the working process, the cylinder IV 49 drives the four V-shaped rollers 28 via the gear II 22, the racks 23 and the guide rails I 24 to synchronously clamp a wheel, and the servo motor II 48 drives the wheel via the right shafts 45 to rotate; the cylinder III 43 drives the belt pulley III 29 via the guide rail II 38 to be located above a riser of the wheel, and the servo motor V 58 drives the brush belt 31 to rotate; meanwhile, the servo motor I 37 drives the brush belt 31 via the shaft III 34 to rotate circumferentially; the cylinders II 42 drive the belt pulley III 29 via the guide posts II 40 to descend, and when the belt pulley III 29 contacts the riser of the wheel, burrs thereon may be removed; the angles of the swing arm 30 and the belt pulley III 29 are adjusted via the servo motor IV 57, and burrs may be removed from an upper flange; the servo motor III 54 drives the spline shaft 7, the spline sleeve 13 and the belt pulley I 8 via the synchronous belt II 52 to rotate so as to drive the brush head 19 to rotate, and ascending and descending of the brush head 19 may be realized via the cylinder I 4; the gear I 18 may be driven by the synchronous belt I 9 and the belt pulley II 10 to rotate, and is engaged with the gear ring 17 to drive the shaft II 16 and the brush disc 20 to rotate; the lifting motion of the brush disc 20 may be realized by means of the cylinders V 55 via the guide posts I 2, and when the brush disc 20 contacts the edge of a flange plate of the wheel, burrs thereon may be removed.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A wheel burr removing device, comprising a frame, guide posts I, four guide sleeves I, a cylinder I, a lower fixed plate, a rotary joint, a spline shaft, a belt pulley I, a synchronous belt I, a belt pulley II, a shaft I, a bearing seat I, a spline sleeve, a bearing seat II, a bearing seat III, a shaft II, a gear ring, a gear I, a brush head, a brush disc, an upper fixed plate, a gear II, racks, guide rails I, a left sliding plate, two left shafts, two left bearing seats, two V-shaped rollers, a belt pulley III, a swing arm, a brush belt, a fixed support, a belt pulley IV, a shaft III, a bearing seat IV, a sliding support, a servo motor I, a guide rail II, an upper lifting plate, four guide posts II, four guide sleeves II, two cylinders II, a cylinder III, a belt pulley V, two right shafts, two right bearing seats, a right sliding plate, a servo motor II, a cylinder IV, a lower lifting plate, a belt pulley VI, a synchronous belt II, a belt pulley VII, a servo motor III, two cylinders V, a turnover shaft, a servo motor IV and a servo motor V, a lower brush system comprises: the four guide sleeves I are fixed on the lower fixed plate, and the guide posts I matched with the guide sleeves I are fixed below the lower lifting plate; the two cylinders V are also fixed below the lower fixed plate, and output ends of the two cylinders V are articulated with the lower part of the lower lifting plate; the bearing seat II is fixed above the lower lifting plate and arranged in the middle; the spline sleeve is mounted inside the bearing seat II via a bearing; the spline shaft is matched with the inner wall of the spline sleeve; the brush head is fixed at the upper end of the spline shaft, and the lower end of the spline shaft is connected with the upper end of the rotary joint; the cylinder I is fixed below the lower lifting plate via a transition flange, and an output end of the cylinder I is connected with the lower part of the rotary joint; both the belt pulley I and the belt pulley VI are fixed below the spline sleeve, and the belt pulley I is arranged below the belt pulley VI; the bearing seat III is fixed above the lower lifting plate, and is concentric with the bearing seat II; the shaft II is mounted outside the bearing seat III via bearings; the gear ring is fixed outside the shaft II; the brush disc is fixed at the top of the shaft II; the bearing seat I is fixed on the lower lifting plate, and arranged on the left side of the shaft II; the shaft I is mounted inside the bearing seat I via bearings; the gear I is fixed at the top of the shaft I, and engaged with the gear ring; the belt pulley II is fixed below the shaft I; the belt pulley I is connected with the belt pulley II via the synchronous belt I; the servo motor III is fixed on the right side of the lower part of the lower lifting plate via a transition flange, and the belt pulley VII is fixed at an output end of the servo motor III; and the belt pulley VI is connected with the belt pulley VII via the synchronous belt II;

a synchronous clamping and rotating system comprises: the gear II is fixed above the upper fixed plate; the left sliding plate is mounted above the upper fixed plate via a guide rail I; the two left bearing seats are fixed above the left sliding plate; the two left shafts are mounted inside the left bearing seats via bearings; two V-shaped rollers are respectively fixed above the two left shafts; the right sliding plate is mounted above the upper fixed plate via a guide rail I; the two right bearing seats are fixed above the right sliding plate; the two right shafts are mounted inside the right bearing seats via bearings; two V-shaped rollers are respectively fixed above the two right shafts; racks are respectively fixed below the left sliding plate and the right sliding plate, and simultaneously engaged with the gear II; the servo motor II is fixed below the right sliding plate, and an output end of the servo motor II is connected with one right shaft; the cylinder IV is fixed on the right side of the frame, and the output end of the cylinder IV is connected with the right sliding plate;

an upper brush system comprises: the belt pulley IV and the belt pulley V are mounted above the fixed support via pin rolls; the upper part of the swing arm is mounted on the fixed support via the turnover shaft; the servo motor IV is fixed on the lateral surface of the fixed support, and the output end of the servo motor IV is connected with one side of the turnover shaft; the belt pulley III is mounted below the swing arm; the servo motor V is fixed on the lateral surface of the fixed support, and the output end of the servo motor V is connected with the belt pulley V; the belt pulley IV, the belt pulley V and the belt pulley III are connected by the brush belt; the bearing seat IV is fixed below a bottom plate of the sliding support; the shaft III is mounted inside the bearing seat IV via a bearing, and the fixed support is fixed below the shaft III; the servo motor I is fixed above a bottom plate of the sliding support, and the output end of the servo motor I is connected with the top of the shaft III; the top of the sliding support is mounted below the upper lifting plate via the guide rail II; the cylinder III is fixed on the right side of the lower part of the upper lifting plate, and the output end of the cylinder III is connected with the sliding support; the four guide posts II are fixed above the upper lifting plate, and the four guide sleeves II matched with the guide posts II are fixed at the top of the frame; the two cylinders II are also fixed at the top of the frame, and the output ends of the two cylinders II are articulated with the upper part of the upper lifting plate.

* * * * *